US007369017B2

(12) United States Patent
Jun et al.

(10) Patent No.: US 7,369,017 B2
(45) Date of Patent: May 6, 2008

(54) MICROSTRIP TYPE BANDPASS FILTER

(75) Inventors: Dong Suk Jun, Daejeon (KR); Hong Yeol Lee, Cheongju (KR); Dong Young Kim, Daejeon (KR); Kyoung Ik Cho, Daejeon (KR); Sang Seok Lee, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 120 days.

(21) Appl. No.: 11/136,471

(22) Filed: May 25, 2005

(65) Prior Publication Data

US 2006/0082425 A1 Apr. 20, 2006

(30) Foreign Application Priority Data

Oct. 18, 2004 (KR) ..... 10-2004-0083337

(51) Int. Cl.
*H01P 1/20* (2006.01)
*H01P 3/08* (2006.01)

(52) U.S. Cl. ..... 333/204; 333/202; 333/24 C

(58) Field of Classification Search ..... 333/202, 333/204, 205, 24 C

See application file for complete search history.

(56) References Cited

U.S. PATENT DOCUMENTS 5,648,747 A 7/1997 Grothe et al.
6,300,849 B1 * 10/2001 Takeda ..... 333/202
6,529,750 B1 3/2003 Zhang et al.
6,608,538 B2 8/2003 Wang
6,809,615 B2 * 10/2004 Sonoda et al. ..... 333/202
6,903,632 B2 * 6/2005 Hashimoto et al. ..... 333/204
6,995,635 B2 * 2/2006 Wung et al. ..... 333/204

OTHER PUBLICATIONS

Hong et al , Microstrip cross coupled trisection bandpass filter with asymmetric frequency characteristics, IEEE Proc- Microw. Antennas Progation vol. 146, No. 1, Feb. 1999.*
Prigent et al, DOE Based Design Method for Coupled Lines Narrow Bandpass Filter Response Improvement,EuMC Sep. 2002.*
Hong, et al; "Microstrip cross-coupled trisection bandpass filters with asymmetric frequency characteristics"; IEE Proc.-Microw Antennas Propag.; Feb. 1999; vol. 146, No. 1; pp. 84-90.
Hong, et al.; "Microstrip Triangular Patch Resonator Filters"; 2000 IEEE MTT-S Digest; TU4C-6; pp. 331-334.

* cited by examiner

*Primary Examiner*—Robert J. Pascal
*Assistant Examiner*—Kimberly E Glenn
(74) *Attorney, Agent, or Firm*—Lowe Hauptman Ham & Berner LLP

(57) ABSTRACT

A narrowband microstrip type bandpass filter adapted for a home network, telematics, an intelligent traffic system, and a satellite Internet, includes: an input terminal for receiving a predetermined signal; an output terminal for outputting a selection signal in a characteristic band; a first resonator electrically coupled with at least a portion of the input terminal; a second resonator electrically coupled with at least a portion of the first resonator; and a third resonator electrically coupled with at least a portion of the output terminal and the second resonator. A magnetic coupling is provided using a cross coupling gap or a cross coupling line between non-adjacent resonators, so that a pattern can be simplified by optimizing the design and the manufacturing process to provide low-cost millimeter-wave parts. The manufacturing cost can be reduced by miniaturizing the parts, and the mass production can be readily realized.

7 Claims, 8 Drawing Sheets

MICROSTRIP TYPE BANDPASS FILTER

CROSS-REFERENCE TO RELATED APPLICATION

This application claims priority to and the benefit of Korean Patent Application No. 2004-83337, filed Oct. 18, 2004, the disclosure of which is hereby incorporated herein by reference in its entirety.

BACKGROUND

1. Field of the Invention

The present invention relates to a narrowband microstrip type bandpass filter adapted to a home network, telematics, an intelligent traffic system, and a satellite Internet and, more specifically, to a microstrip type bandpass filter, in which a pattern can be simplified by optimizing the design and the manufacturing process to provide low-cost millimeter-wave parts, the manufacturing cost can be reduced by miniaturizing the parts, and the mass production can be readily realized.

2. Discussion of Related Art

Recently, a millimeter-wave application has been proposed in a field such as a home network, telematics, an intelligent traffic system and a satellite Internet. To succeed in these markets with the millimeter wave technology, one should reduce the cost and size of the parts considerably.

FIGS. 1A and 1B are pattern diagrams for illustrating a microstrip type bandpass filter according to a first example of the prior art, in which FIG. 1A is a pattern diagram for a bandpass filter having an attenuation pole at an upper side of the passband, and FIG. 1B is a pattern diagram for a bandpass filter having an attenuation pole at a lower side of the passband.

Referring to FIGS. 1A and 1B, the bandpass filter according to the first example of the prior art are formed with a cross coupling and an open loop resonator, which have a microstrip type asymmetric frequency characteristic, comprising an input terminal 10, an output terminal 11, an input resonator 12, an upper resonator 13, and an output resonator 14.

Here, an electric coupling 18 between the input terminal 10 and the input resonator 12, an electric coupling 15 between the input resonator 12 and the upper resonator 13, an electric coupling 16 between the upper resonator 13 and the output resonator 14, an electric coupling 19 between the output terminal 11 and the output resonator 14, and a magnetic coupling 8 between the input resonator 12 and the output resonator 14 are formed, respectively.

Further, as shown in FIG. 1A, since the input terminal 10 and the output terminal 11 contact with the input resonator 12 and the output resonator 14, an electric coupling 18 between the input terminal 10 and the input resonator 12 and an electric coupling 19 between the output terminal 11 and the output resonator 14 do not exist.

When a signal is input through the input terminal 10, the input signal is electrically coupled 18 between the input terminal 10 and the open loop input resonator 12, and the signal electrically coupled 18 is transferred again to the upper resonator 13 by the electric coupling 15 with the open loop upper resonator 13, and transferred to the open loop output resonator 14 through the electric coupling 16 between the open loop upper resonator 13 and the open loop output resonator 14. In addition, the transferred signal is transferred again to the output after selecting the characteristic band through the electric coupling 19 between the output terminal 11 and the open loop output resonator 14.

The coupling provided in FIG. 1A is largely composed of an electric coupling, and the coupling between the open loop input resonator 12 and the open loop output resonator 14 is an electric coupling. Therefore, the attenuation pole characteristic is formed at the upper side of the band, and the attenuation pole characteristic and the frequency are adjusted using a cross coupling.

In addition, the coupling provided in FIG. 1B is largely composed of an electric coupling, and the coupling between the open loop input resonator 12 and the open loop output resonator 14 is a magnetic coupling, so that the attenuation pole characteristic is formed at the lower side of the band.

However, although the open loop resonator is suitable for a wireless communication system adapted to a high selectivity channeling and low insertion loss, only one attenuation pole is formed and a design is limited based on the dielectric coefficient. [J. S. Hong, M. J. Lancater (1999.02), "Microstrip cross coupled trisection bandpass filters with asymmetric frequency characteristics", IEE proc Microwave and antennas propagation, Vol 146. No 1, pp. 84-90].

FIGS. 2A and 2B are pattern diagrams for illustrating a microstrip type bandpass filter according to a second example of the prior art, in which FIG. 2A is a pattern diagram of a bandpass filter having an attenuation pole at the upper side of the passband, and FIG. 2B is a pattern diagram of a bandpass filter having an attenuation pole at the lower side of the passband.

Referring to FIGS. 2A and 2B, the bandpass filter according to the second example of the prior art is formed with a cross coupling and a triangular patch resonator, which have a microstrip type asymmetric frequency characteristic. Here, a filter using the triangular patch resonator has a small size and forms one attenuation pole at a high/low frequency of the passband by the electric coupling and the magnetic coupling.

In other words, the bandpass filter using the triangular patch resonator comprises an input terminal 20, an output terminal 21, an input resonator 22, an upper resonator 23, and an output resonator 24.

An electric coupling 28 between the input terminal 20 and the input resonator 22, an electric coupling 25 between the input resonator 22 and the upper resonator 23, an electric coupling 26 between the upper resonator 23 and the output resonator 24, an electric coupling 29 between the output terminal 21 and the output resonator 24, and a magnetic coupling 27 between the input resonator 22 and the output resonator 24 are formed, respectively.

Further, as shown in FIG. 2A, since the input terminal 20 and the output terminal 21 contact with the input resonator 22 and the output resonator 24, an electric coupling 28 between the input terminal 20 and the input resonator 22 and an electric coupling 29 between the output terminal 21 and the output resonator 24 do not exist.

When a signal is input through the input terminal 20, the input signal is electrically coupled 28 between the input terminal 20 and the triangular patch input resonator 22, and the signal electrically coupled 28 is transferred again to the triangular patch upper resonator 23 by the electric coupling 25, and transferred to the triangular patch output resonator 24 through the electric coupling 26 in the triangular patch upper resonator 23. In addition, the transferred signal is transferred again to the output after selecting the characteristic band through the electric coupling 29 between the output terminal 21 and the triangular patch output resonator 24.

The coupling provided in FIG. 2A is largely composed of an electric coupling, and the coupling between the triangular patch input resonator 22 and the triangular patch output resonator 24 is an electric coupling. Therefore, the attenuation pole characteristic is formed at the upper side of the band, and the attenuation pole characteristic and the frequency are adjusted using a cross coupling.

In addition, the coupling provided in FIG. 2B is largely composed of an electric coupling, and the coupling between the input resonator 22 and the triangular patch output resonator 24 is a magnetic coupling, so that the attenuation pole characteristic is formed at the lower side of the band. The conventional bandpass filter using the triangular patch resonator is suitable for a wireless communication system adapted to a high selectivity channeling and low insertion loss [J. S. Hong, M. J. Lancater (2000), "Microstrip triangular patch resonator filters", IEEE MTTS digest, pp. 331-334].

FIG. 3 is a pattern diagram for illustrating a microstrip type bandpass filter according to a third example of the prior art, which is a pattern diagram of the resonator made of a multi-layer substrate.

Referring to FIG. 3, the microstrip type bandpass filter according to the third example of the prior art comprises an input terminal port1, an output terminal port2, input resonators L11, L12, and C1, upper resonators L21, L22, and C2, and output resonators L31, L32, and C3.

The three resonators formed in a typical multi-layer substrate comprise inductance portions and capacitance portions. The inductance portion of the second resonator couples that of the first resonator and that of the third resonator in the triangular form. In addition, the attenuation pole is formed below the passband by a cross coupling between the first resonator and the third resonator.

When a signal is input through the input terminal port1, the input signal resonates through the input resonator L11, L12, and C1, and the resonated signal is transferred to the upper resonator L21, L22, and C2 to resonate by the electric coupling, and again, transferred to the output resonator L31, L32, and C3 to resonate by the electric coupling. Next, the resonated signal is output through the output terminal port2.

Here, a main coupling of the filter is made of an electric coupling, and the coupling between the input resonator L11, L12, and C1 and the output resonator L31, L32, and C3 is a magnetic coupling. Therefore, the attenuation pole characteristic is formed at the upper side of the passband, and the attenuation pole characteristic and the frequency are adjusted by the cross coupling. The conventional bandpass filter uses an LC coupling resonator in the multi-layer substrate, which is suitable for a microwave device and miniaturization (U.S. Pat. No. 6,608,538 (Sep. 19, 2003)).

FIG. 4 is a pattern diagram for illustrating a microstrip type bandpass filter according to a fourth example of the prior art, which is a pattern diagram of a bandpass filter formed with an LC resonator, and the resonator type is an LC coupling resonator.

Referring to FIG. 4, the microstrip type bandpass filter according to the fourth example of the prior art includes three LC coupling resonators, a cross coupling gap, a cross coupling line or a mixed structure of a cross coupling gap and a cross coupling line on the substrate. Here, the microstrip type bandpass filter comprises an input terminal 30, an output terminal 31, an input resonator 32, an upper resonator 33, and an output resonator 34.

In addition, with regard to the coupling between the respective resonators, there exist a coupling 35 between the input resonator 32 and the upper resonator 33, a coupling 36 between the upper resonator 33 and the output resonator 34, a cross coupling gap 37 between the input resonator 32 and the output resonator 34, a cross coupling line 38 between the input resonator 32 and the output resonator 34, and the cross coupling gap 37 and the cross coupling line 38 between the input resonator 32 and the output resonator 34.

A microwave signal is flowed into the LC coupling input resonator 32 through the input terminal 30, transferred to the LC coupling upper resonator 33 through the electric coupling, and transferred again to the output terminal 31 via the LC coupling output resonator 34. In addition, the attenuation pole is formed at the upper and lower side of the passband by the cross coupling gap, the cross coupling line, or a combination thereof between the LC coupling input resonator 32 and the LC coupling output resonator 34.

The main coupling of the bandpass filter described above is an electric coupling, and the cross coupling is a magnetic coupling or an electric coupling, and it is suitable for a microwave device and miniaturization since the LC coupling resonator is used.

However, recently, the costs and the size of the passive device such as a bandpass filter should be significantly reduced due to a miniaturization of the millimeter wave system for the home network, telematics, the intelligent traffic system, and the satellite Internet. According to the prior arts, it is difficult to implement a bandpass filter having a minimum width of 2.0 mm or less. This is because, when the width is 2.0 mm or more, an unwanted waveguide mode is generated in a waveguide when shielding the bandpass filter.

SUMMARY OF THE INVENTION

The present invention is directed to a microstrip type bandpass filter, in which an electric coupling physically coupled in parallel is provided between the input/output terminal and the resonator and between the resonators, and a magnetic coupling is provided using a cross coupling gap or a cross coupling line between non-adjacent resonators, so that a pattern can be simplified by optimizing the design and the manufacturing process to provide low-cost millimeter-wave parts, the manufacturing cost can be reduced by miniaturizing the parts, and the mass production can be readily realized.

One aspect of the present invention is to provide a microstrip type bandpass filter comprising: an input terminal for receiving a predetermined signal; an output terminal for outputting a selection signal in a characteristic band; a first resonator electrically coupled with at least a portion of the input terminal; a second resonator electrically coupled with at least a portion of the first resonator; and a third resonator electrically coupled with at least a portion of the output terminal and the second resonator.

Here, a cross coupling gap having a predetermined interval may be formed between the first resonator and the third resonator.

The cross coupling gap may be formed in a magnetic coupling such that an attenuation pole characteristic is generated at the upper side of a passband.

An attenuation frequency of the attenuation pole may be changed as the interval of the cross coupling gap is changed.

The first to third resonators may be $\lambda/2$ transmission line resonators.

The microstrip type bandpass filter may further comprise a cross coupling line coupled in a combinational manner of a capacitive coupling to at least the portion of the input terminal and at least the portion of the output terminal and inductive coupling to the transmission line.

The cross coupling line may generate an attenuation pole characteristic at the upper and lower sides of the passband.

An attenuation frequency of the attenuation pole may be changed according to the interval between the first resonator and the third resonator.

An attenuation frequency of the attenuation pole may be changed according to a length variation or a width variation of the cross coupling line.

BRIEF DESCRIPTION OF THE DRAWINGS

The above and other features of the present invention will be described in reference to certain exemplary embodiments thereof with reference to the attached drawings in which:

FIG. 9A is a Pi-type equivalent circuit of a cross coupling gap, FIG. 9B is a circuit diagram of conversion of FIG. 9A into an ideal J-inverter, and FIG. 9C is a circuit diagram of conversion of FIG. 9B into ideal J-inverter and transmission line.

FIG. 10A is a equivalent circuit of a cross coupling gap shown in FIG. 9C, FIG. 10B is an equivalent diagram of a cross coupling transmission line, and FIG. 10C is a conversion circuit diagram of a cross coupling of FIG. 10B.

DETAILED DESCRIPTION OF PREFERRED EMBODIMENTS

Exemplary embodiments of the present invention will now be described with reference to the attached drawings. However, these embodiments are illustrative only, and should not be construed as a limiting sense.

First Embodiment

Figure 1A:
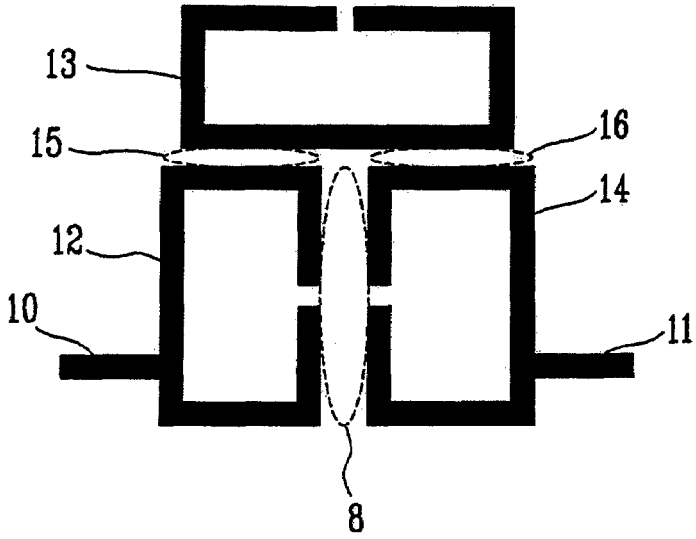
(PRIOR ART) FIG. 1a
FIGS. 1A and 1B are pattern diagrams for illustrating a microstrip type bandpass filter according to a first example of the prior art.
Figure 1B:
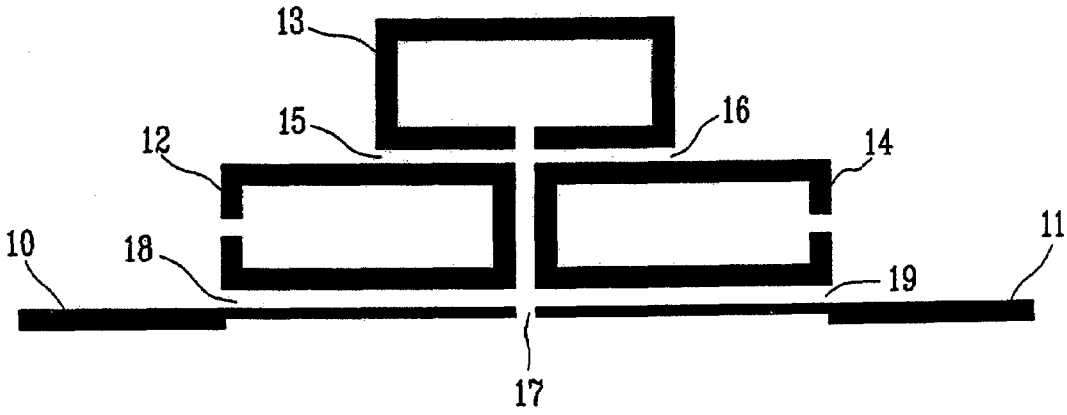
(PRIOR ART) FIG. 1b
Figure 2A:
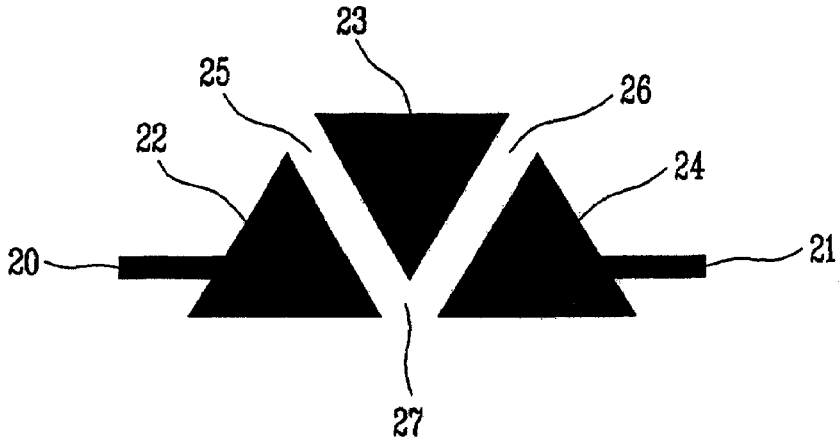
FIG. 2a (PRIOR ART)
FIGS. 2A and 2B are pattern diagrams for illustrating a microstrip type bandpass filter according to a second example of the prior art.
Figure 2B:
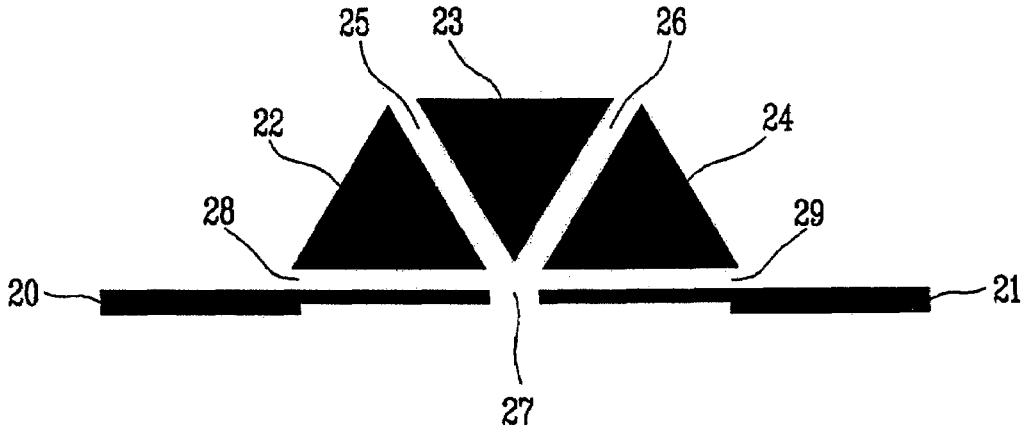
FIG. 2b (PRIOR ART)
Figure 3:
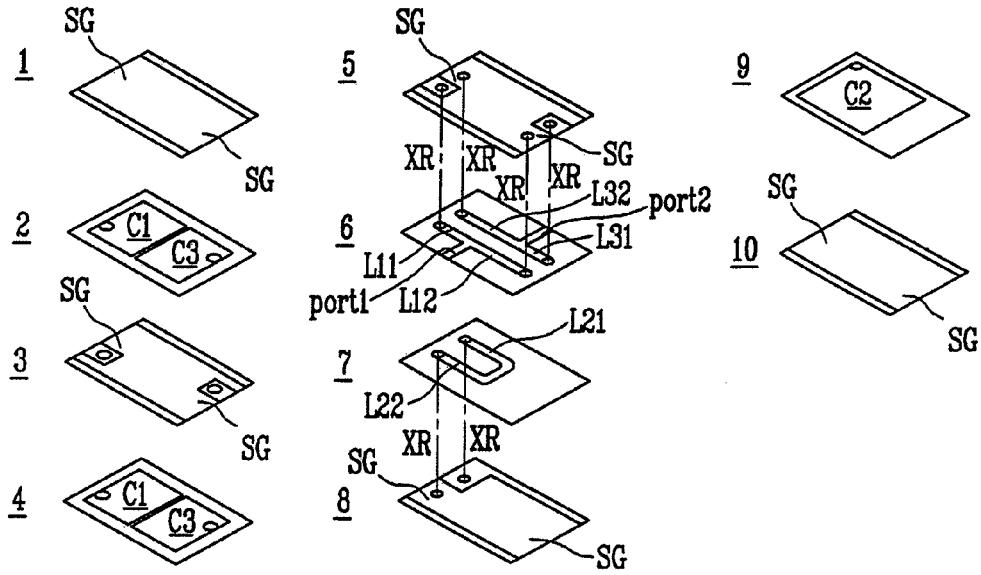
FIG. 3 (PRIOR ART)
FIG. 3 is a pattern diagram illustrating a microstrip type bandpass filter according to a third example of the prior art.
Figure 4:
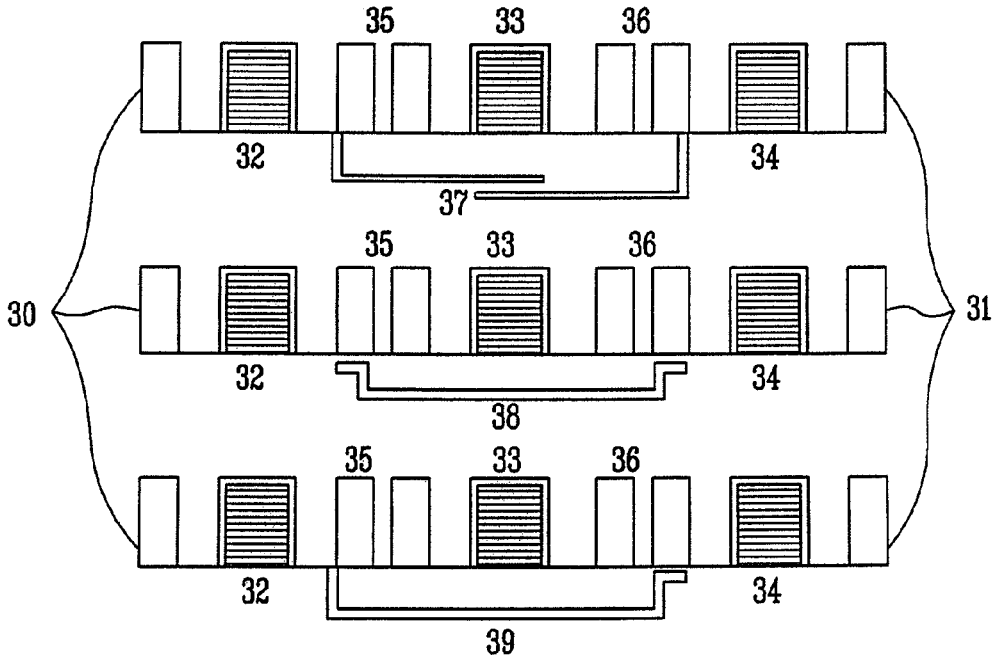
FIG. 4 (PRIOR ART)
FIG. 4 is a pattern diagram illustrating a microstrip type bandpass filter according to a fourth example of the prior art.
Figure 5:
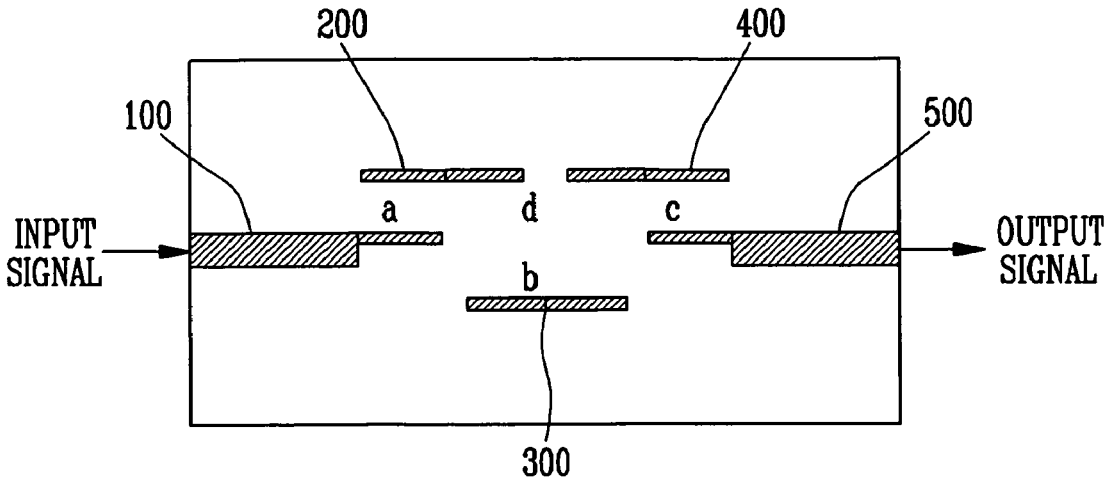
FIG. 5 is a pattern diagram for illustrating a microstrip type bandpass filter according to a first embodiment of the present invention.

FIG. 5 is a pattern diagram for illustrating a microstrip type bandpass filter according to a first embodiment of the present invention, which is a pattern diagram of a bandpass filter having a microstrip type asymmetric frequency characteristic and formed with a cross coupling and a λ/2 transmission line resonator.

Referring to FIG. 5, the microstrip type bandpass filter according to the first embodiment of the present invention comprises an input terminal 100, first to third resonators 200 to 400, and an output terminal 500.

Here, the microstrip type bandpass filter according to the first embodiment of the present invention is a type of a parallel coupling filter, in which there are provided an electric coupling (a) between the input terminal 100 and the first resonator 200, an electric coupling (b) between the first resonator 200 and the second resonator 300 and between the second resonator 300 and the third resonator 400, and an electric coupling (c) between the third resonator 400 and the output terminal 500, respectively. The electric couplings (a) to (c) are physically parallel coupling.

In addition, a cross coupling gap (d) having an attenuation pole characteristic is formed between the first resonator 200 and the third resonator 400.

Further, the first to third resonators 200 to 400 are preferably made of λ/2 transmission line resonators.

In FIG. 5, when the input signal having microwave/millimeter wave is input through the input terminal 100, for example, the input signal is electrically coupled (a) to the input terminal 100. Here, the impedance is easily adjusted using image impedance irrespective of dielectric constant.

An electric coupling a is formed at the input terminal 100, and the input signal having microwave/millimeter wave is input to the first resonator 200 which is a .lamda./2 transmission line resonator. The input signal having microwave/millimeter wave is transferred to the second resonator 300 by an electric coupling (b) between the first resonator 200 and the second resonator 300.

The second resonator 300 transfers the input signal having the microwave/millimeter wave to the third resonator 400 by the electric coupling (b) between the second resonator 300 and the third resonator 400, and the input signal having the microwave/millimeter wave is filtered by the electric coupling (c) between the third resonator 400 and the output terminal 500 so that a selection signal in a characteristic band is output to the output terminal 500.

A coupling of the bandpass filter according to the first embodiment of the present invention largely consists of an electric coupling, and a coupling between the first resonator 200 and the third resonator 400 consists of a magnetic coupling due to a cross coupling gap (d). Therefore, the attenuation pole characteristic is formed at the upper side of the band. Further, the attenuation pole characteristic and the frequency can be adjusted with the cross coupling gap (d).

Figure 6:
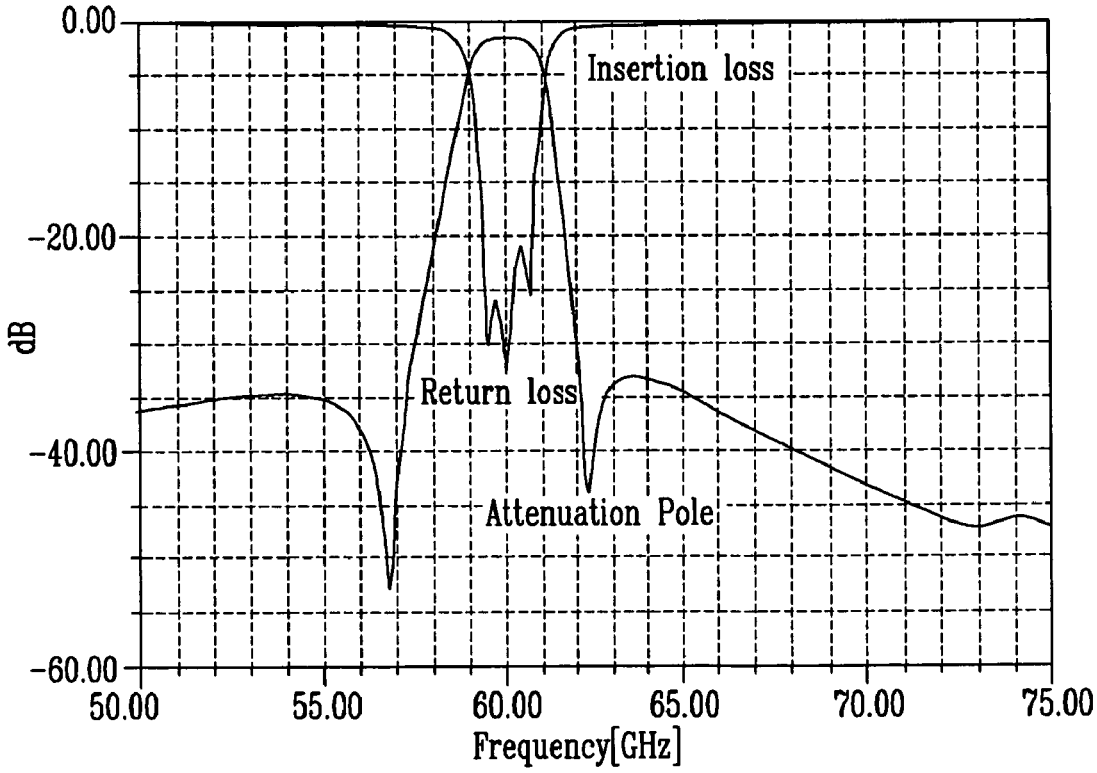
FIG. 6 is a graph showing a response characteristic from an experiment when the frequency of the microstrip type bandpass filter according to the first embodiment of the present invention is 60 GHz.

FIG. 6 is a graph showing a response characteristic from an experiment when the frequency of the microstrip type bandpass filter according to the first embodiment of the present invention is 60 GHz, which is a response characteristic obtained while designing and fabricating a microstrip type bandpass filter under the following condition.

For example, when the fabricated and designed microstrip type bandpass filter has a frequency of 60 GHz under the condition where a substrate made of $Al_2O_3$ has a dielectric constant $\epsilon_r$ of 9.4, a dielectric loss tan δ of 0.0005, and a thickness of 0.2 mm; Au has a thickness of 0.2 μm; the first resonator 200 has a length of 0.901 mm and a width of 0.061 mm/0.071 mm; the second resonator 300 has a length of 0.894 mm and a width of 0.071 mm; the third resonator 400 has a length of 0.901 mm and a width of 0.061 mm/0.071 mm; the electric couplings (a) and (c) have a length of 0.434 mm, a width of 0.061 mm, and a gap of 0.207 mm; the electric coupling (b) has a length of 0.317 mm, a width of 0.071 mm, and a gap of 0.6 mm; and the cross coupling gap (d) has a width of 0.071 mm and a gap of 0.26 mm, an attenuation pole is generated at the upper side of the bandpass frequency.

Second Embodiment

Figure 7:
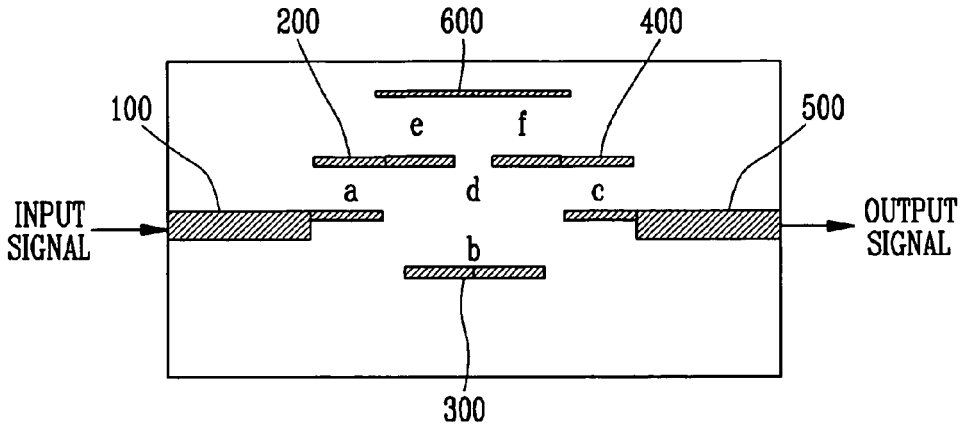
FIG. 7 is a pattern diagram for illustrating a microstrip type bandpass filter according to a second embodiment of the present invention.

FIG. 7 is a pattern diagram for illustrating a microstrip type bandpass filter according to a second embodiment of the present invention, in which like numerals refer to like elements with respect to the identical portions to the microstrip type bandpass filter according to the first embodiment of the present invention shown in FIG. 5, i.e., the input terminal 100, the first to third resonators 200 to 400, the output terminal 500 and the electric couplings (a) to (c) and the cross coupling gap (d).

Referring to FIG. 7, the microstrip type bandpass filter according to the second embodiment of the present invention is formed with a cross coupling having a microstrip type symmetric frequency characteristic and a λ/2 transmission line resonator. In particular, the microstrip type bandpass filter according to the second embodiment of the present invention further comprises cross couplings (e) and (f) of the cross coupling line 600.

Here, there are provided an electric coupling (a) between the input terminal 100 and the first resonator 200, an electric coupling (b) between the first resonator 200 and the second resonator 300 and between the second resonator 300 and the third resonator 400, and an electric coupling (c) between the third resonator 400 and the output terminal 400, respectively. The electric couplings (a) to (c) are physically parallel coupling.

In addition, a cross coupling gap (d) having an attenuation pole characteristic is formed between the first resonator 200 and the third resonator 400, and the cross coupling (e) and (f) is formed with a cross coupling 600 arranged at the upper side.

Further, the first to third resonators 200 to 400 are preferably made of λ/2 transmission line resonators.

In FIG. 7, when the input signal having microwave/millimeter wave is input through the input terminal 100, for example, the input signal is electrically coupled (a) to the input terminal 100. Here, the impedance is easily adjusted using image impedance irrespective of dielectric constant.

The electric coupling a is formed at the input terminal 100, and the input signal having microwave/millimeter wave is input to the first resonator 200 which is the lamda/2 transmission line resonator. The input signal having microwave/millimeter wave is transferred to the second resonator 300 by an electric coupling (b) between the first resonator 200 and the second resonator 300.

The second resonator 300 transfers the input signal having the microwave/millimeter wave to the third resonator 400 by the electric coupling (b) between the second resonator 300 and the third resonator 400, and the input signal having the microwave/millimeter wave is filtered by the electric coupling (c) between the third resonator 400 and the output terminal 500 so that a selection signal in a characteristic band is output to the output terminal 500.

A coupling of the bandpass filter according to the second embodiment of the present invention largely consists of an electric coupling, and a coupling between the first resonator 200 and the third resonator 400 consists of an magnetic coupling due to a cross coupling gap (d). In addition, the cross coupling (e) and (f) of the cross coupling 600 formed between the first resonator 200 and the third resonator 400 are coupled in a composite type having a serialized pi-type capacitive coupling and a transmission line inductive coupling.

Therefore, the bandpass filter according to the second embodiment of the present invention has the attenuation pole characteristic of the cross coupling gap (d) formed at the upper side of the passband. The attenuation pole characteristic due to the cross coupling line 600 is formed at the lower side of the passband. In other words, the attenuation pole characteristic and the frequency can be adjusted with the cross coupling line 600 and the cross coupling gap (d).

Figure 8:
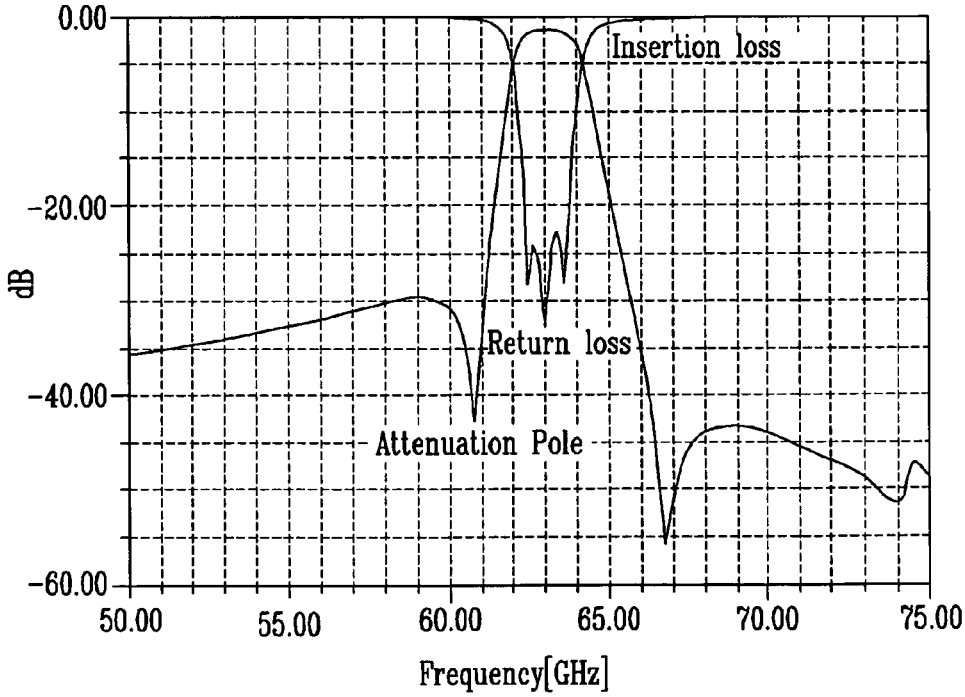
FIG. 8 is a graph showing a response characteristic from an experiment when the frequency of the microstrip type bandpass filter according to the second embodiment of the present invention is 60 GHz.

FIG. 8 is a graph showing a response characteristic from an experiment when the frequency of the microstrip type bandpass filter according to the second embodiment of the present invention is 60 GHz, which is a response characteristic obtained while designing and fabricating a microstrip type bandpass filter under the following condition.

For example, when the fabricated and designed microstrip type bandpass filter has a frequency of 60 GHz under the condition where a substrate made of $Al_2O_3$ has a dielectric constant $\epsilon_r$ of 9.4, a dielectric loss tan δ of 0.0005, and a thickness of 0.2 mm; Au has a thickness of 0.2 μm; the first resonator 200 has a length of 0.853 mm and a width of 0.061 mm/0.071 mm; the second resonator 300 has a length of 0.85 mm and a width of 0.071 mm; the third resonator 400 has a length of 0.853 mm and a width of 0.061 mm/0.071 mm; the electric couplings (a) and (c) have a length of 0.408 mm, a width of 0.061 mm, and a gap of 0.214 mm; the electric coupling (b) has a length of 0.295 mm, a width of 0.071 mm, and a gap of 0.64 mm; the cross coupling gap (d) has a width of 0.071 mm and a gap of 0.26 mm, the cross coupling line has a 1.312 mm and a width of 0.03 mm; the cross coupling s (e) and (f) have a length of 0.408 mm, widths of 0.061/0.03 mm, 0.071/0.03 mm, and a gap of 0.35 mm, an attenuation pole is generated at the upper side of the bandpass frequency.

As shown in FIG. 8, in the cross coupling line 600, an attenuation frequency of the attenuation pole is changed according to an interval of the first resonator 200 and the third resonator 400. In addition, the attenuation frequency of the attenuation pole may be changed according to variation of a length or a width of the cross coupling line 600.

Figure 9A:
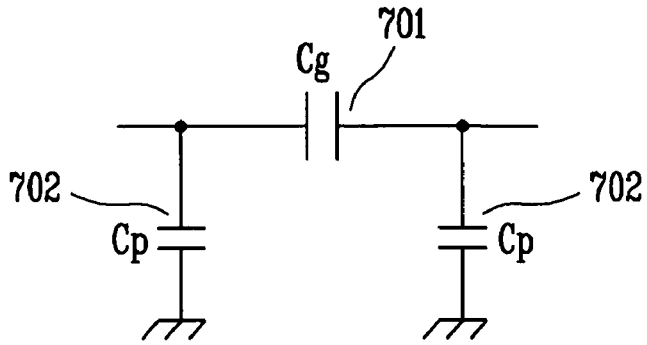
FIGS. 9A to 9C are equivalent circuit diagrams of a cross coupling having a microstrip type asymmetric frequency characteristic according to an embodiment of the present invention, where
Figure 9B:
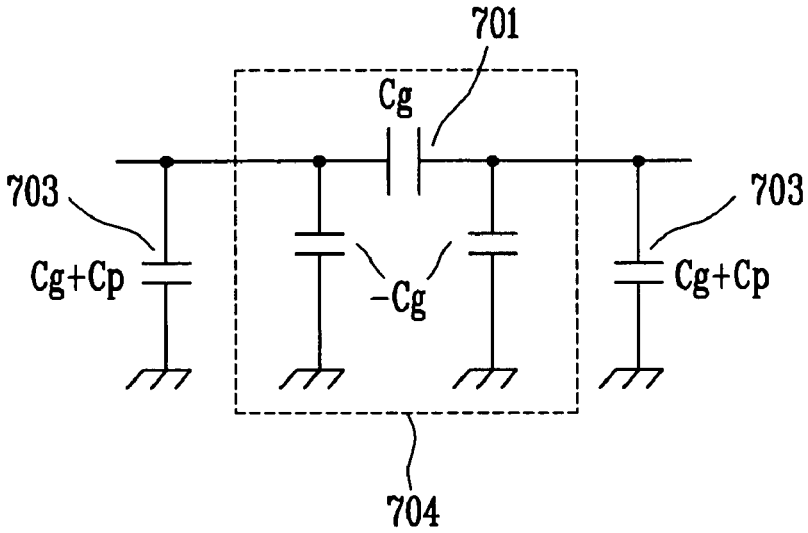
Figure 9C:
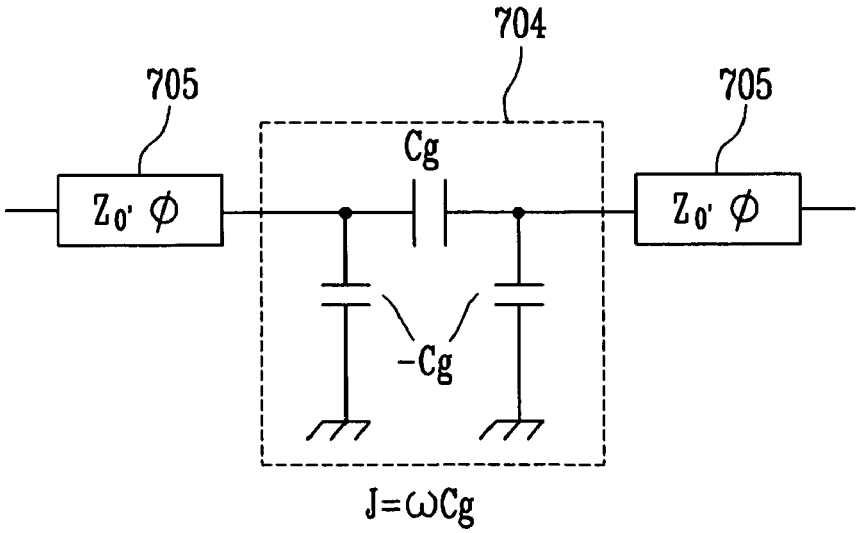

FIGS. 9A to 9C are equivalent circuit diagrams of a cross coupling having a microstrip type asymmetric frequency characteristic according to an embodiment of the present invention, where FIG. 9A is a Pi-type equivalent circuit of a cross coupling gap, FIG. 9B is a circuit diagram of conversion of FIG. 9A into an ideal J-inverter, and FIG. 9C is a circuit diagram of conversion of FIG. 9B into ideal J-inverter and transmission line.

Referring to FIGS. 9A to 9C, a capacitance of the cross coupling gap (d) is indicated by Cg 701; Cp 702 for a capacitance between ground and the transmission line; Cg+Cp 703 for a sum of Cg and Cp; J=ωCg(704) for the J-inverter; and $Z_o\Phi$ (705) for the transmission line.

Here, J-inverter and susceptance are found using the following equations 1 to 4.

$$J = Y_o \tan\left|\frac{\Phi}{2}\right| \quad \text{[Equation 1]}$$

$$\Phi = -\tan^{-1}\frac{2B}{Y_o} \quad \text{[Equation 2]}$$

$$\left|\frac{B}{Y_o}\right| = \frac{\frac{J}{Y_o}}{1-\left(\frac{J}{Y_o}\right)^2} \quad \text{[Equation 3]}$$

$$B_g = \omega C_g \quad \text{[Equation 4]}$$

Figure 10A:
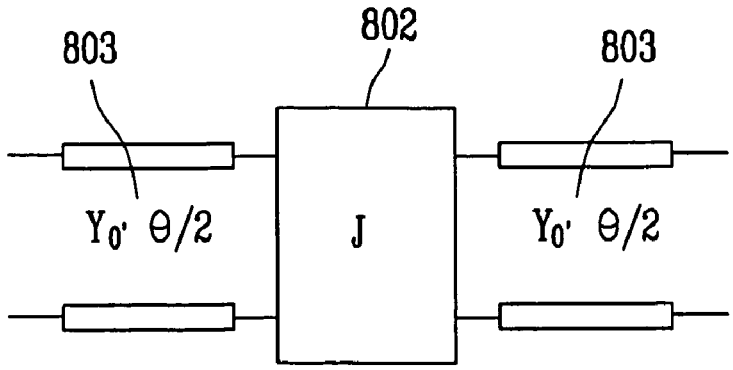
FIGS. 10A to 10C are another equivalent circuit diagrams of a cross coupling having a microstrip type asymmetric frequency characteristic according to another embodiment of the present invention, where
Figure 10B:
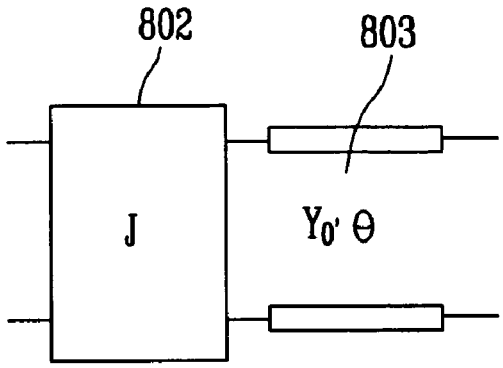
Figure 10C:
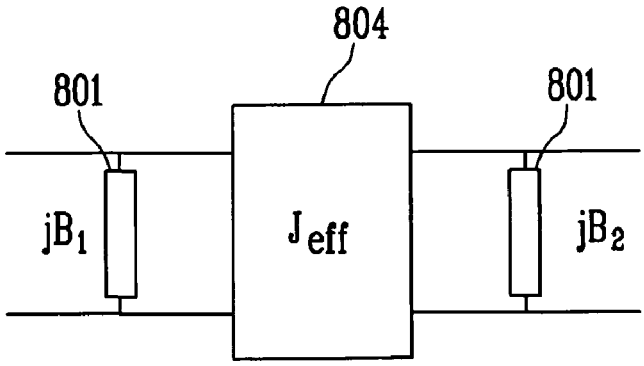

FIGS. 10A to 10C are another equivalent circuit diagrams of a cross coupling having a microstrip type asymmetric frequency characteristic according to another embodiment of the present invention, where FIG. 10A is a equivalent circuit of a cross coupling gap shown in FIG. 9C, FIG. 10B is an equivalent diagram of a cross coupling transmission line, and FIG. 10C is a conversion circuit diagram of a cross coupling of FIG. 10B.

Referring to FIGS. 10A to 10C, FIG. 10A is found using the above equations 1 to 4 as FIG. 9C. FIGS. 10A and 10B can be converted into FIG. 10C, respectively.

Here, when FIG. 10A is converted into FIG. 10C, the J-inverter and susceptance are found using the following equations 5 and 6. In addition, when FIG. 10B is converted into FIG. 10C, the J-inverter and susceptance are found using the following equation 7 to 9.

$$J_{eff} = \frac{1}{\left(\frac{-J\sin^2\frac{\theta}{2}}{Y_o^2} + \frac{\cos^2\frac{\theta}{2}}{J}\right)} \quad \text{[Equation 5]}$$

$$B(\omega) = \frac{\sin\frac{\theta}{2}\cos\frac{\theta}{2}\left(\frac{J}{Y_o}+\frac{Y_o}{J}\right)}{\left(\frac{-J\sin^2\frac{\theta}{2}}{Y_0^2} + \frac{\cos^2\frac{\theta}{2}}{J}\right)} = J_{eff}\left(\sin\frac{\theta}{2}\cos\frac{\theta}{2}\left(\frac{J}{Y_o}+\frac{Y_o}{J}\right)\right) \quad \text{[Equation 6]}$$

$$J_{eff} = \frac{J}{\cos\theta} \quad \text{[Equation 7]}$$

$$B_1(\omega) = -\frac{J^2}{Y_o}\tan\theta \quad \text{[Equation 8]}$$

$$B_2(\omega) = -Y_o\tan\theta \quad \text{[Equation 9]}$$

Figure 11:
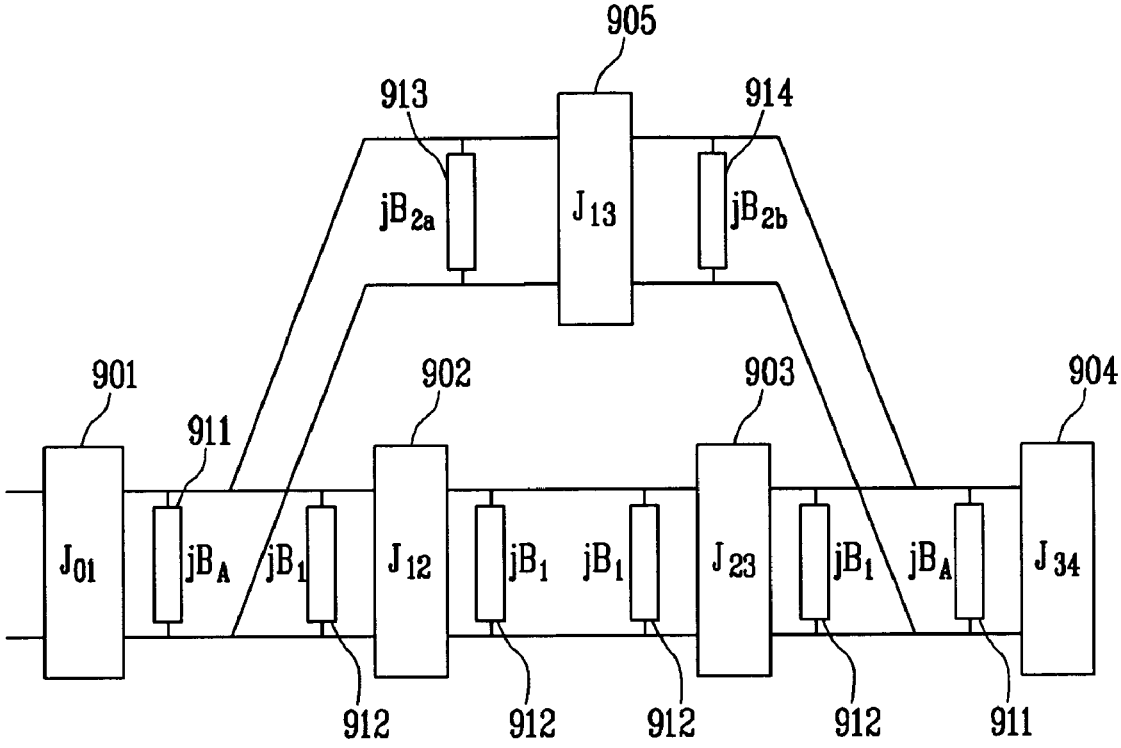
FIG. 11 is an equivalent circuit diagram of a bandpass filter having a cross coupling gap and line according to the first and second embodiments of the present invention.

FIG. 11 is an equivalent circuit diagram of a bandpass filter having a cross coupling gap of the present invention.

Referring to FIG. 11, reference numerals 901 to 906 indicate inverters, 911 and 912 indicate susceptance, 913 and 914 indicate susceptance of the cross coupling gap.

In FIG. 11, input admittance seen at an input stage is found using the following equation 10.

$$Y_{in} = Y_1\frac{Y_o + jY_1\tan\beta l}{Y_1 + jY_o\tan\beta l} = Y_1\frac{Y_1 - jY_o\cot\beta l}{Y_o - jY_1\cot\beta l} = \quad \text{[Equation 10]}$$

$$Y_1\frac{Y_1 - jY_o\cot\left(\frac{\pi}{2}\frac{\omega}{\omega_o}\right)}{Y_o - jY_1\cot\left(\frac{\pi}{2}\frac{\omega}{\omega_o}\right)} = Y_1\frac{Y_1 + jY_o\tan\left(\frac{\pi}{2}\left(\frac{\omega-\omega_o}{\omega_o}\right)\right)}{Y_o + jY_1\tan\left(\frac{\pi}{2}\left(\frac{\omega-\omega_o}{\omega_o}\right)\right)} =$$

-continued $$Y_1\frac{\frac{Y_1}{Y_o} + j\left(\frac{\pi}{2}\left(\frac{\omega-\omega_o}{\omega_o}\right)\right)}{1 + j\frac{Y_1}{Y_o}\left(\frac{\pi}{2}\left(\frac{\omega-\omega_o}{\omega_o}\right)\right)}\Bigg|_{\omega=\omega_o} = \frac{Y_1^2}{Y_o} + jY_1X(1-A^2)$$

In equation 10, $$\frac{1}{j\tan\beta l} = j\cot\beta l,\quad \beta l = \frac{2\pi}{\lambda_o}\theta = \frac{\pi}{2},\quad A = \frac{Y_1}{Y_o},\quad X(\omega) = \frac{\pi}{2}\left(\frac{\omega-\omega_o}{\omega_o}\right)$$

Further, the following relationships are used:

$$\cot\left(\frac{\pi}{2}\frac{\omega}{\omega_o}\right) = -\tan\left(\frac{\pi}{2}\frac{\omega}{\omega_o} - \frac{\pi}{2}\right) = -\tan\left(\frac{\pi}{2}\left(\frac{\omega-\omega_o}{\omega_o}\right)\right)$$

Further, admittance seen at the $J_{01}$ inverter (901) can be found using the following equation 11.

$$Y_A = \frac{J_{01}^2}{Y_{in}} = \frac{J_{01}^2}{\frac{Y_1^2}{Y_o} + jY_1X(1-A^2)} = \frac{J_{01}^2}{Y_1A + jY_1X(1-A^2)} = \frac{J_{01}^2}{Y_1A}\left[1 + jX\left(A - \frac{1}{A}\right)\right] = \frac{J_{01}^2}{Y_1A} + jB_A(\omega) \quad \text{[Equation 11]}$$

In equation 11, the λ/2 transmission line resonator $jB_A(\omega)$ can be found using the following equation 12.

$$B_A(\omega) = \frac{J_{01}^2}{Y_1A}X(\omega)\left(A - \frac{1}{A}\right) = \frac{J_{01}^2}{Y_1}X(\omega)\left(1 - \frac{1}{A^2}\right) \quad \text{[Equation 12]}$$

Susceptance of the second resonator 200, which is the λ/2 transmission line resonator, can be derived using the following equation 13.

$$B_1(\omega) = B_A(\omega) + B_2(\omega) + B_g(\omega) \quad \text{[Equation 13]}$$

With the above equations, the electric coupling (a) of the input stage is formed, so that the input signals having microwave/millimeter wave are transferred to the first resonator 200, and the input signals having microwave/millimeter wave are transferred to the second resonator 300 by the electric coupling (b) between the first resonator 200 and the second resonator 300.

When the length of the transmission line is 2Θ=λ/2, the second resonator 300 can be formed using the following equation 14.

$$Z_{in} = Z_1\frac{Z_L + jZ_1\tan\beta l}{Z_1 + jZ_L\tan\beta l} = Z_1\frac{Z_L + jZ_1\pi\left(\frac{\omega-\omega_o}{\omega_o}\right)}{Z_1 + jZ_L\pi\left(\frac{\omega-\omega_o}{\omega_o}\right)}\Bigg|_{\omega=\omega_o} = \quad \text{[Equation 14]}$$

-continued $$Z_1 \frac{1 + j\frac{Z_1}{Z_L}\pi\left(\frac{\omega-\omega_o}{\omega_o}\right)}{\frac{Z_1}{Z_L} + j\pi\left(\frac{\omega-\omega_o}{\omega_o}\right)}\Bigg|_{\omega=\omega_o} = \frac{Z_1}{j\pi\left(\frac{\omega-\omega_o}{\omega_o}\right)}\Bigg|_{\omega=\omega_o} = \frac{1}{jY_1\pi\left(\frac{\omega-\omega_o}{\omega_o}\right)}\Bigg|_{\omega=\omega_o}$$

The susceptance of the second resonator 300 can be found using the following equation 15.

$$B_2(\omega) = Y_1\pi\left(\frac{\omega-\omega_o}{\omega_o}\right) = Y_1 2X(\omega) \quad \text{[Equation 15]}$$

The second resonator 300 transfers the input signals having microwave/millimeter wave by the electric coupling (b). The transferred input signals having microwave/millimeter wave are filtered and output to the output stage by the electric coupling (c).

The second and third resonators 300 and 400 can be formed using the following equation 16.

$$B_2(\omega)=B_1(\omega)+B_g(\omega)=B_3(\omega) \quad \text{[Equation 16]}$$

As described above, according to the present invention, an attenuation frequency of an attenuation pole can be adjusted by changing the cross coupling gap (d) and the cross coupling line 600 without the change of the passband.

According to the microstrip type bandpass filter of the present invention as described above, an electric coupling is formed physically in parallel between the input/output terminals and the resonator and between the resonators, and a magnetic coupling are formed with a cross coupling gap or a cross coupling line between the non-adjacent resonators. Therefore, the design and the fabrication process can be optimized and the pattern can be simplified to implement low-cost millimeter products. In addition, the manufacturing costs can be reduced by miniaturizing the parts, and the mass production can be easily realized.

Further, according to the present invention, the limitation of the filter design due to a dielectric constant can be relieved, and the pattern shape can be simplified. Thus, the manufacturing process according to the design process can be optimized and the manufacturing cost is reduced. Accordingly, the present invention can be advantageously suitable for millimeter wave applications, such as a home network, telematics, an intelligent traffic system, and a satellite internet system module, i.e, system on package, and microwave applications, such as mobile communication, personal communication, CT and an RF stage filter of the satellite communication system, and a filter for removing an image.

Although the microstrip type bandpass filter according to the exemplary embodiments of the present invention has been described, the present invention is not limited hereto, but a variety of modification can be made within the claims, the detailed description of the invention, and the attached drawings, which are also included in the present invention.

What is claimed is:

1. A microstrip type bandpass filter, comprising:

an input terminal for receiving a predetermined signal;

an output terminal for outputting a selection signal in a characteristic band;

a first resonator electrically coupled with at least a portion of the input terminal;

a second resonator electrically coupled with at least a portion of the first resonator; and a third resonator electrically coupled with at least a portion of the output terminal and the second resonator;

wherein a cross coupling gap having a predetermined interval is formed between the first resonator and the third resonator; and the cross coupling gap is formed in a magnetic coupling such that an attenuation pole characteristic is generated at the upper side of a passband;

said microstrip type bandpass filter further comprising a cross coupling line that overlaps at least a part of the first resonator and at least a part of the third resonator;

said bandpass filter comprising a capacitive coupling comprising the cross coupling gap of the predetermined interval between the first resonator and the third resonator in combination with an inductive coupling comprising the cross coupling line and said parts of the first resonator and the third resonator.

2. The microstrip type bandpass filter according to claim 1, wherein the cross coupling line generates two different attenuation poles at the upper and lower sides of the passband, respectively.

3. The microstrip type bandpass filter according to claim 2, wherein an attenuation frequency of the attenuation pole is changed according to the interval between the first resonator and the third resonator.

4. The microstrip type bandpass filter according to claim 2, wherein an attenuation frequency of the attenuation pole is changed according to a length variation of the cross coupling line.

5. The microstrip type bandpass filter according to claim 2, wherein an attenuation frequency of the attenuation pole is changed according to a width variation of the cross coupling line.

6. A microstrip type bandpass filter, comprising:

an input terminal for receiving a predetermined signal;

an output terminal for outputting a selection signal in a characteristic band;

a first resonator electrically coupled with at least a portion of the input terminal;

a second resonator electrically coupled with at least a portion of the output terminal; and a third resonator electrically coupled with at least a portion of the first resonator and at least a portion of the second resonator;

wherein said first and second resonators are disposed at a first side of the input and output terminals, whereas said third resonator is disposed on a second, opposite side of the input and output terminals; and a cross coupling gap having a predetermined interval is formed between the first resonator and the second resonator, and defines a magnetic coupling between said first and second resonators.

7. The microstrip type bandpass filter according to claim 6, further comprising:

a cross coupling line that overlaps at least a part of the first resonator and at least a part of the second resonator, and defines at least an inductive coupling with said parts of the first and second resonators;

wherein said cross coupling line is disposed on the first side of the input and output terminals, so that said first and second resonators are disposed between (i) the cross coupling line on one hand, and (ii) the input and output terminals on the other hand.

* * * * *